United States Patent [19]

Brooks et al.

[11] Patent Number: 5,022,248

[45] Date of Patent: Jun. 11, 1991

[54] PRESS BRAKE APPARATUS WITH POWERED ADJUSTABLE FEMALE DIE JAWS

[75] Inventors: Gene R. Brooks, Bolingbrook; Terrence T. Hiland, Marseilles, both of Ill.

[73] Assignee: Caterpillar Inc., Peoria, Ill.

[21] Appl. No.: 596,440

[22] Filed: Oct. 12, 1990

[51] Int. Cl.[5] ..... B21D 5/02

[52] U.S. Cl. ..... 72/21; 72/389; 72/446; 72/478; 72/481

[58] Field of Search ..... 72/21, 31, 357, 381, 72/382, 389, 446, 448, 461, 481, 482, 478

[56] References Cited

U.S. PATENT DOCUMENTS

| | | | |
|---|---|---|---|
| 1,965,716 | 7/1934 | Thoms et al. | 153/48 |
| 2,310,525 | 2/1943 | Heller | 153/22 |
| 2,456,749 | 12/1948 | Steibel | 152/21 |
| 2,650,637 | 9/1953 | Paxson | 153/48 |
| 3,029,858 | 4/1962 | Harper | 153/21 |
| 3,209,576 | 10/1965 | Giordano | 72/389 |
| 3,271,990 | 9/1966 | Mitchell | 72/389 |
| 3,323,348 | 6/1967 | Pearson | 73/473 |
| 3,748,890 | 7/1973 | Thatcher | 72/383 |
| 4,356,718 | 11/1982 | Makino | 72/389 |
| 4,366,698 | 1/1983 | Gill | 72/389 |
| 4,638,665 | 1/1987 | Benson et al. | 72/389 |
| 4,680,955 | 7/1987 | Sakamoto | 72/462 |
| 4,790,173 | 12/1988 | Boutcher, Jr. | 72/446 |

FOREIGN PATENT DOCUMENTS

| | | | |
|---|---|---|---|
| 3235775 | 3/1984 | Fed. Rep. of Germany | 72/389 |
| 3711970 | 10/1988 | Fed. Rep. of Germany | 72/389 |
| 2411043 | 7/1979 | France | 72/389 |
| 29830 | 9/1975 | Japan | 72/389 |
| 24779 | 2/1980 | Japan | 72/389 |
| 423544 | 4/1974 | U.S.S.R. | 72/381 |
| 496072 | 12/1975 | U.S.S.R. | 72/389 |

*Primary Examiner*—David Jones

*Attorney, Agent, or Firm*—Sterling R. Booth, Jr.

[57] ABSTRACT

Conventional press brake female dies which have to be manually adjusted are not adaptable to today's automated factories for producing different shaped components on a demand basis. The subject apparatus overcomes this problem by providing powered, adjustable female die jaws that are positively located by powered rotary shims having several thicknesses to be presented according to the desired opening between the jaws. The power source for adjusting the jaws and the rotary shims may be controlled electronically to adjust the jaws to a position to produce a prescribed shape from a plate of metal.

5 Claims, 5 Drawing Sheets

PRESS BRAKE APPARATUS WITH POWERED ADJUSTABLE FEMALE DIE JAWS

TECHNICAL FIELD

This invention relates to an adjustable female lower die for a press brake for forming metal plate into prescribed shapes for different components of finished assemblies and more particularly to a powdered rotary shim device to positively secure the jaws of the die in their prescribed location.

BACKGROUND ART

The assignee of this invention is presently in the process of changing its manufacturing facilities to what has become known as the (PWAF) "Plant With A Future". Such facilities are being equipped with machining cells that are automatically controlled and operated, requiring little or no manual attention of a machine operator. It has, therefore, become a problem with all machining operations to modify or to change them to automatic adjustment means and/or readily changeable fixtures or tooling to accommodate various and different components being manufactured on the same machines.

The fabricating facilities are equipped with numerous metal forming equipment, some of which are commonly referred to as press brakes. Such machines have elongated male punches powered by hydraulic rams which press against a sheet of metal, in most cases steel, against a set of spaced jaws of a female die forming an opening below the male punch. As the punch engages the plate against the opening between the jaws, the plate is formed into an angular shape as prescribed by the component to be produced. These machines are quite large in size, some having dies in the eight to twelve feet length capable of withstanding forces of a press having a 2,000 ton capacity. The plate being formed is frequently one-half to one inch in thickness requiring considerable force and dies capable of withstanding such force.

Past female die equipment has had jaws that are adjustable, being movable toward and away from each other to create an opening suitable for the reception of the male punch to provide the required shape. In such equipment, the dies were supported on a die frame and attached thereto in guide means that were loosened and manually forced to a new position and then manually changing shims between the jaws and the frame to positively locate the jaws in such location. As can be appreciated, this is a time consuming operation requiring an operator or operators to make such changes which is not readily adaptable to an automatic machining operation.

Adjustment means as shown in U.S. Pat. No. 3,748,890, issued to Russell S. Thatcher, is shown wherein a ratchet type mechanism is used to locate the dies or jaws of the die in a prescribed location. Although such system has merit, it would only be adaptable to lighter press work and such locating means would not be sufficiently strong enough to positively hold the dies in the heavier punching operations. U.S. Pat. No. 3,029,858, issued to Harper, U.S. Pat. No. 3,223,348 issued to Pearson, and U.S. Pat. No. 2,456,749 issued to Steibel, disclose a female die which is a one piece construction with various shapes cut into the outer periphery of the die to provide different openings for forming of different types of components out of sheet metal. It is obvious from these systems that the material being worked would have to be thin in thickness and therefore would not be adaptable to the heavier work, although they are readily adjustable to the different shapes.

The present invention is directed to overcoming the problems as set forth above.

DISCLOSURE OF THE INVENTION

In one aspect of the invention, an apparatus for bending plate material into different angular shapes includes a frame and a vertically reciprocal ram mounted thereon to which horizontally elongated punches having different cross sectional contours are adapted to be singularly and removably secured for movement with the ram. A horizontally adjustably elongated female die is mounted to the frame below the ram with elongated jaws on either side of the punch to support the plate. The jaws form an opening centered below and along the elongated punch, the female being an adjustable die having movable opposed die jaws secured to the frame by elongated slot means and motor means which reciprocably move the jaws to adjust them to selected various positions to change the opening in concert with the punch to form the flat plate into different angular shapes. Rotary shims are provided which have areas of various thicknesses mounted between the frame and the jaws of the female die, the rotary shim being rotated to present the selective thickness to provide a solid stop between the frame and the jaws at the selected various positions of the jaws.

Hydraulic means is provided to reciprocally move the jaws to the prescribed position and the rotary shims are supported and attached to a shaft powered by an electric motor and a gear reduction device to cause the different thicknesses of the rotary shim to be presented between the frame and the jaws to positively hold them in the prescribed position. A rotary encoder attached to the shaft determines the angular position of the rotary shim, stopping the motor when the proper thickness is in place.

BEST MODE FOR CARRYING OUT THE INVENTION

Figure 1:
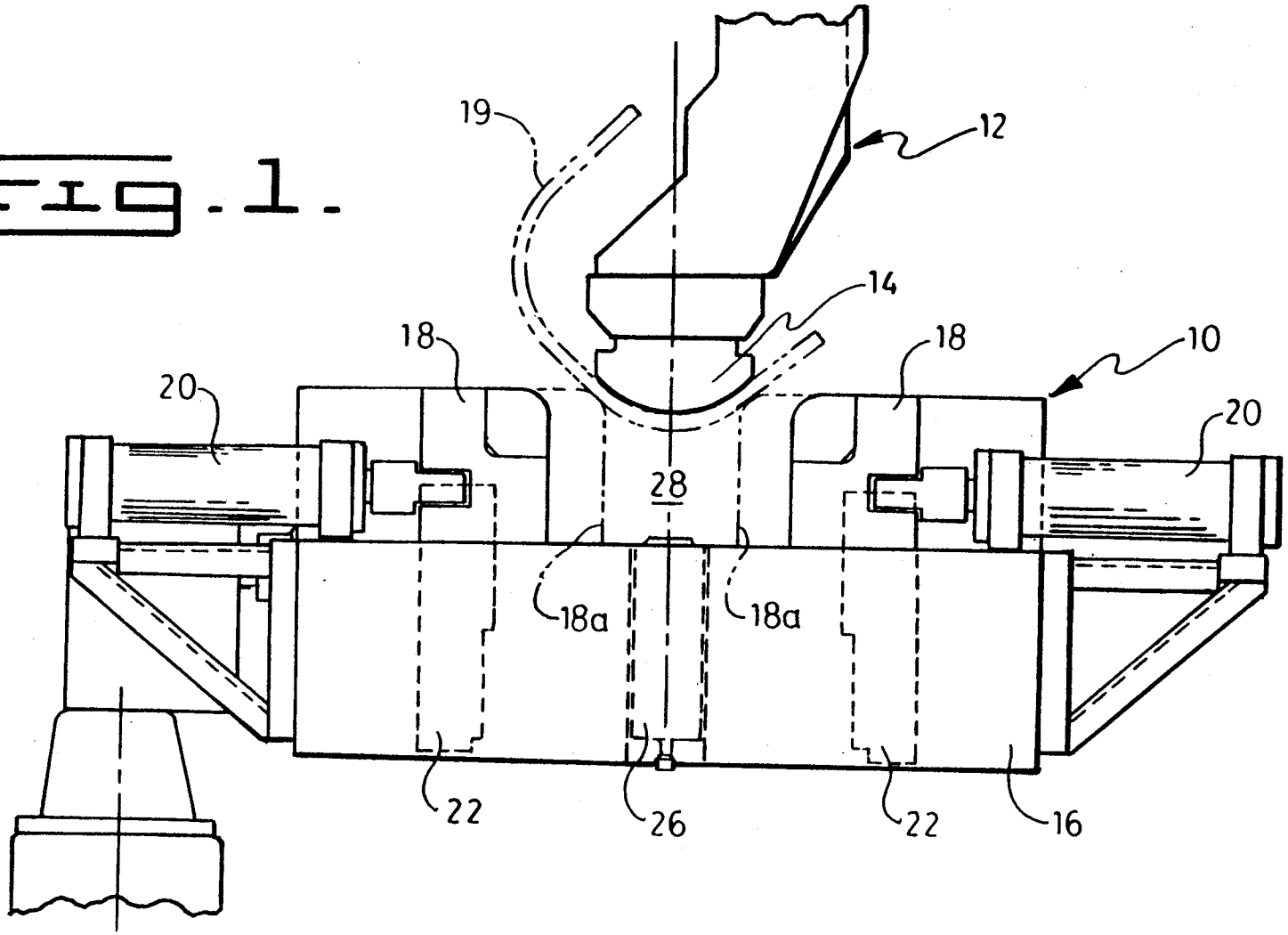
FIG. 1 is an end elevational view of the female die and male punch with a component shown by phantom lines as being partially formed into a prescribed shape.

In FIG. 1, the arrangement of the female die 10 and the male punch 12 of a press brake are shown with jaws 18 in their outermost position with a plate 19 shown in broken lines being formed against the jaws moved to an intermediate position 18*a* as shown in broken lines. The male punch incorporates an interchangeable die or dies 14 which have different contours. Located below the male punch 12 is a die frame 16 to which is mounted the female die 10. The female die has opposing die jaws 18, slidably mounted and secured to the die frame 16.

The die jaws 18 are moved to their selected locations by motor means or hydraulic cylinders 20. Also shown in broken lines in this view are rotary shims 22.

A push-out cylinder 26 shown in broken lines below an opening 28 between the jaws 18 of the female die serves to push the completed component from the female die.

Figure 3:
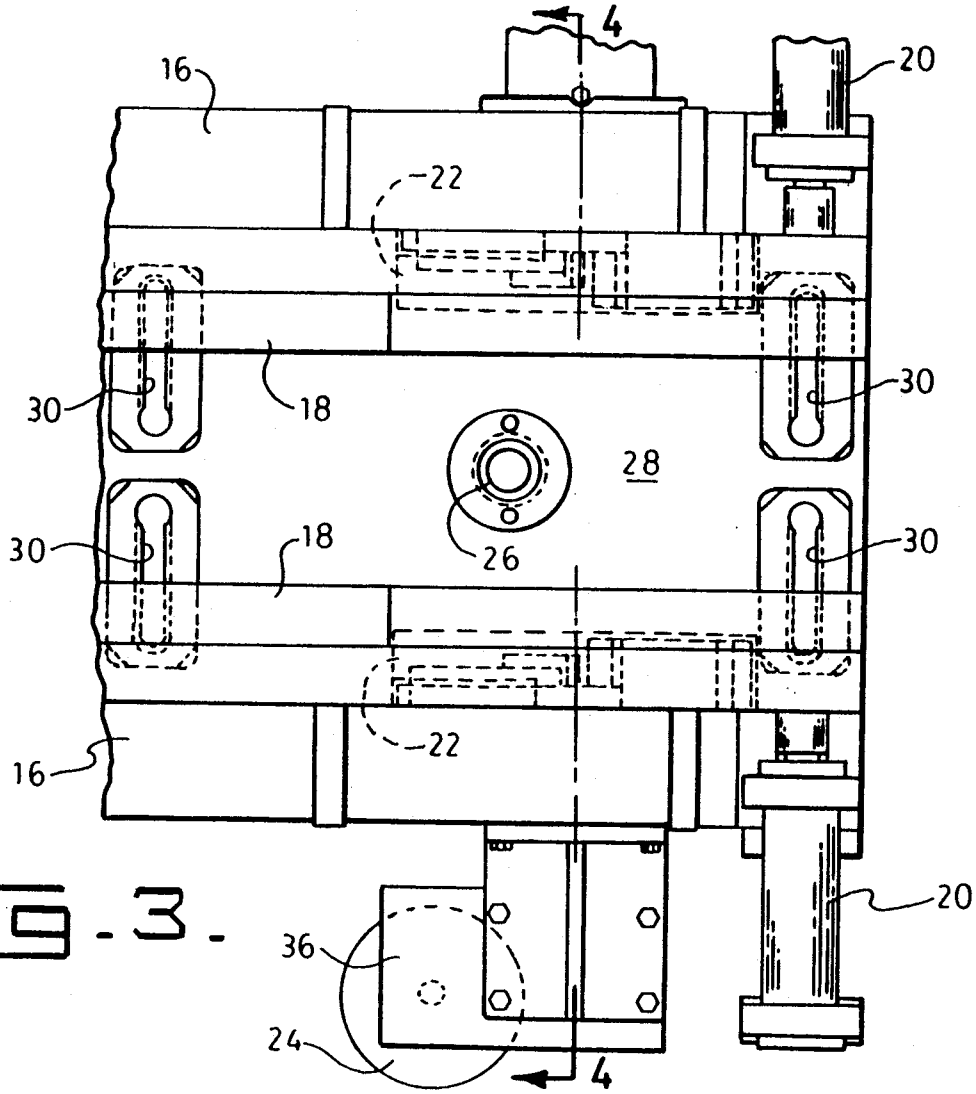
FIG. 3 is a top plan view of the female die disclosing one end of the female die with the elements to move and secure the jaws.

As can be seen in FIG. 3, the jaws 18 are supported and guided on the frame 16 by slot and pin means 30. As also can be seen from this view, the rotary shims 22 are located on either side of the female die 10 so as to be located between the frame 16 and the moveable jaws 18. It should be pointed out that this view is a partial view of the dies showing only one end thereof. A similar arrangement would be at the opposite end of the female die.

Figure 2:
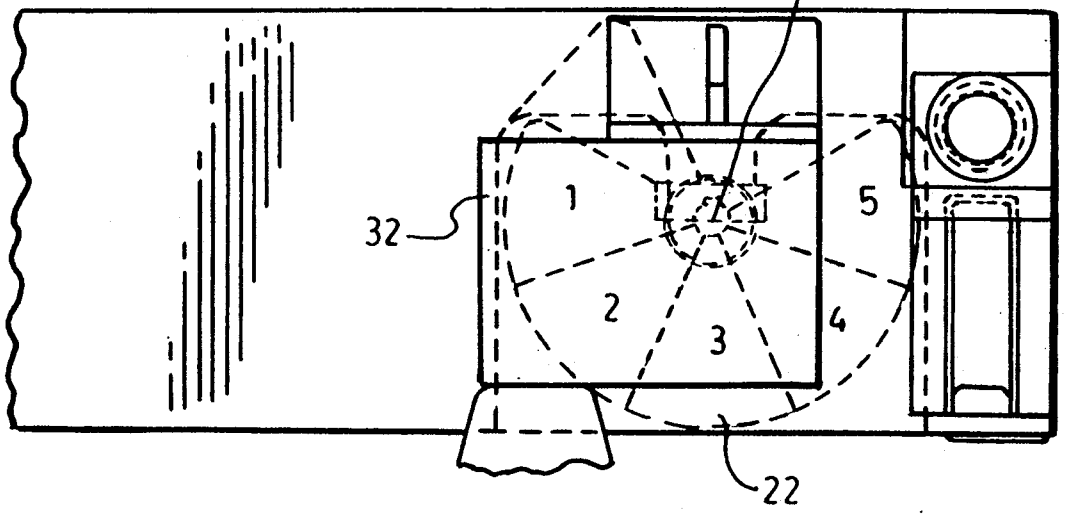
FIG. 2 is a partial front elevational view of the female die showing one of the rotary shims.
Figure 4:
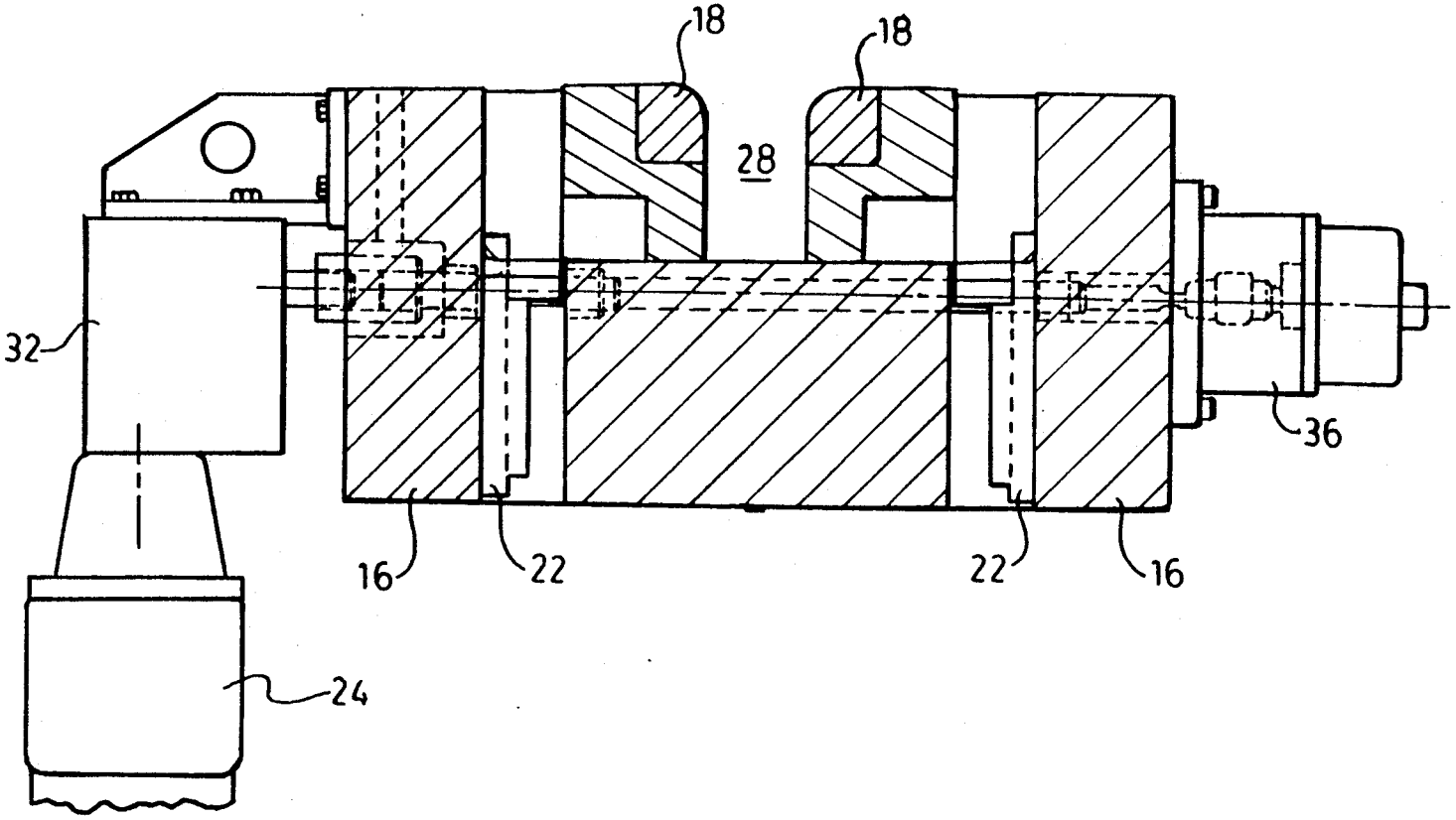
FIG. 4 is a cross sectional view taken along section 4 for FIG. 3 with the jaws shown adjusted and locked at an intermediate position.
Figure 5:
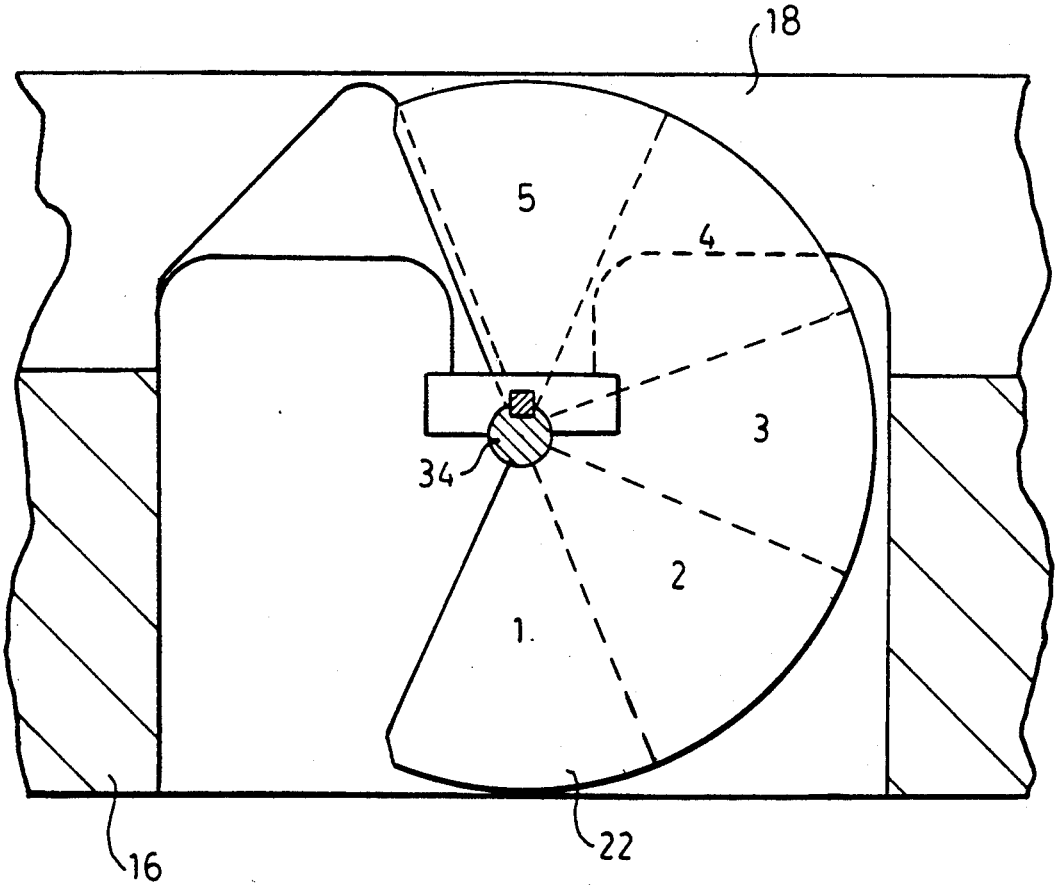
FIG. 5 is an enlarged broken away view of the rotary shim showing the different sections of thicknesses of the rotary shim to be located between the frame and the jaws to lock them in position.

In FIGS. 2 and 5, the enlarged view of the rotary shim 22 is shown wherein the different thicknesses of the shim is indicated by broken lines. The rotary shim has five distinct thicknesses designated in FIG. 5 and 1 through 5 which can be selectively rotated into position between the frame 16 and the jaws 18 to provide a positive stop or locator therefor.

In FIG. 4, which is a cross sectional view taken through FIG. 3, disclosing the adjustable shims 22 and the moveable die jaws 18. The adjustable shims 22 are rotated by an electric motor 24 and gear box 32. The gear box is secured or attached to a shaft 34 which is keyed to the rotary shims 22. In this view, the jaws are shown at an intermediate position or location with the proper thickness of the rotary shim rotated into position to lock the jaws in that location.

Although not shown, it is to be understood that the motors 24 and the hydraulic cylinders 20 are controlled by an electronic/hydraulic control to cause them to position the jaws 18 and lock them in a position as prescribed by the form selected to bend the plate into its prescribed shape. The angular position of the shims is determined by an encoder 36 attached to the shaft 34. The encoder produces a signal that is sent to the control to stop the rotation of the rotary shims 22.

INDUSTRIAL APPLICABILITY

The above described apparatus provides an electrical/hydraulic means to adjust the jaws of the female die to present the proper opening for the selected punch to form a plate of steel or other material into a shape prescribed by the design of the component.

In such operation, the machine operator would select the appropriate controls to cause the machine to automatically position the opposing jaws to setting them in the proper relationship for the opening required to work in conjunction with a particular die to produce the required shape.

The controls cause the hydraulic cylinders to move the jaws into their innermost position. Thus, the stepping motors rotate the proper thickness of the shim into position after which the hydraulic cylinders retract, pulling the jaws up against the rotary shims.

In this manner, the female dies are readily and quickly adjusted to be adapted to different forms to be manufactured from a steel plate making the apparatus compatible with automatic manufacturing facilities.

It is also obvious that the control may be operated by a computer, wherein only an identifier would have to be entered that would select the jaw position. Other aspects, objects, and advantages become apparent from study of this specification, drawings, and appended claims.

We claim:

1. An apparatus for bending flat plate material into different angular shapes, said apparatus having a frame and a vertically reciprocable ram thereon to which horizontally elongated punches of different cross sectional contours are adapted to be singly and removably secured for movement therewith, a horizontally adjustable elongated female die mounted on said frame below the ram with elongated jaws on either side of the punch to support the plate, said jaws forming an opening centered below and along the elongated punches, the opening being operative in concert with the punch to form the flat plate into different angular shapes, the improvement comprising:

means for reciprocably moving the jaws to adjust them to selected spaced positions to change said opening;

a rotary shim mounted between the frame and each jaw, each rotary shim having a plurality of adjacent lands disposed in parallel planes; and means for rotating each rotary shim to present a selected land to provide a stop between the frame and the respective jaw at the selected various positions of the jaw.

2. The apparatus, as set forth in claim 1, wherein the means for reciprocably moving the jaws includes powered motor devices anchored to the frame and attached to the jaws.

3. The apparatus, as set forth in claim 2, wherein the powered motor devices are hydraulically powered.

4. The apparatus, as set forth in claim 1, wherein the rotary shims are supported and attached to a shaft powered by a motor means, said shaft having means attached thereto for determining the angular position of the rotary shims.

5. The apparatus, as set forth in claims 4 and 3, wherein the powered motor devices for adjusting the dies and the motor for adjusting the rotary shims are automatically positioned in accordance with a signal produced by an electronic control.

* * * * *